US006347965B1

(12) United States Patent
Pan

(10) Patent No.: US 6,347,965 B1
(45) Date of Patent: Feb. 19, 2002

(54) ELECTRICAL CONNECTION MECHANISM USED IN A MINIATURE LIGHT BULB STRING

(76) Inventor: Wun Fang Pan, No. 123, Lane 99, Pu Din Road, Hsinshu (TW)

( * ) Notice: Subject to any disclaimer, the term of this patent is extended or adjusted under 35 U.S.C. 154(b) by 0 days.

(21) Appl. No.: 09/722,433

(22) Filed: Nov. 28, 2000

(51) Int. Cl.[7] ..... H01R 17/00
(52) U.S. Cl. ..... 439/699.2
(58) Field of Search ..... 439/699.2, 619, 439/505

(56) References Cited

U.S. PATENT DOCUMENTS 4,592,615 A * 6/1986 Durand ..... 439/619
5,810,621 A * 9/1998 Tsai ..... 439/619
5,848,916 A * 12/1998 Huang ..... 439/699.2
6,019,483 A * 2/2000 Lin ..... 439/375
6,053,774 A * 4/2000 Lin ..... 439/619
6,123,433 A * 9/2000 Chen ..... 439/619
6,142,646 A * 11/2000 Liu ..... 439/375

* cited by examiner

*Primary Examiner*—Brian Sircus
*Assistant Examiner*—Phuong Dinh
(74) *Attorney, Agent, or Firm*—Rosenberg, Klein & Lee

(57) ABSTRACT

An electrical connection mechanism used in a miniature light bulb string mainly comprises a block or plug that can be inserted into the lower portion of a bulb holder shell. The block or plug is provided with a U-shaped conductor plate that presses against two opposite conductive terminals when it is seated in the shell to form an electrical connection between the terminals. Thus when one of the light bulbs is in malfunction, electrical current in the miniature light bulb string still can be maintained.

2 Claims, 4 Drawing Sheets

ELECTRICAL CONNECTION MECHANISM USED IN A MINIATURE LIGHT BULB STRING

BACKGROUND OF THE INVENTION

Christmas decorative light bulb strings typically have a serial connection circuit to connect miniature light bulbs in a string. Once one of the light bulbs fails, the circuit is interrupted and all light bulbs in the string will not be lit up. Thus it is desirable to have improvements made on such structure In the past some proposals were offered to overcome the aforesaid shortcoming. For instances U.S. Pat. No. 6053774 uses Y-shaped blocks in the holder shell and an electrical connection bar on the top. When a connection sleeve is assembled with a holder shell, the Y-shaped blocks and the electrical connection bar are held in contact with two opposite electrical connection terminals. Such design is inconvenient in manufacturing and increases complexity of assembling processes. Worse than that, the structure can not provide reliable electrical connection and thus it does not meet practical requirements in the field.

In view of the above problems, the primary object of the invention is to provide an electrical connection means used in a miniature light bulb string that ingeniously combines the light bulb holder and a conductor plate to form a parallel connection circuit there between. It has the advantages of the enhanced reliability of a light bulb string and an elongated service life. Now the features and the advantages of the invention will be described in detail with reference to the accompanying drawings. shell with two downwardly extending wires; said U-shaped conductor plate abutting against the two conductive terminals to form an electrical connection in parallel with said miniature light bulb when said connection sleeve is seated in a holder shell.

BRIEF DESCRIPTION OF THE ACCOMPANYING DRAWINGS

DETAILED DESCRIPTION OF THE INVENTION

Figure 1:
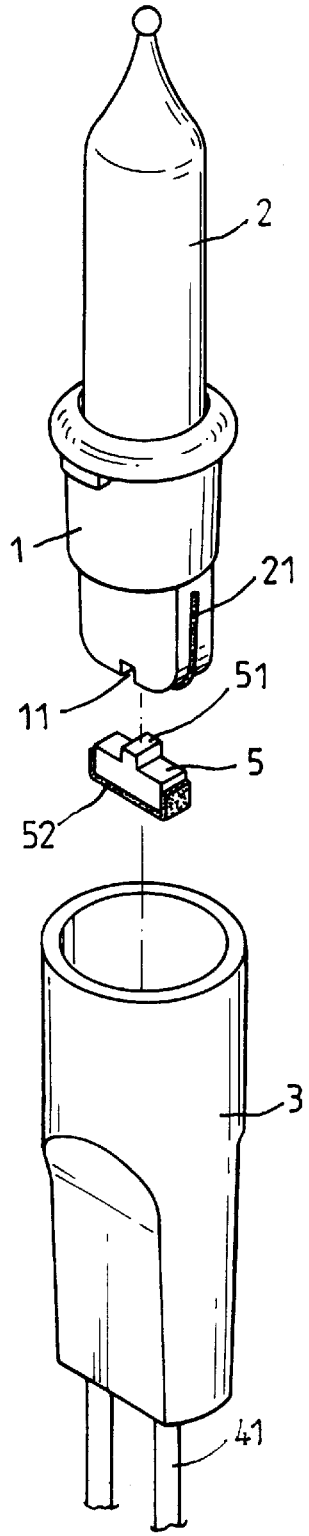
FIG. 1 is an exploded view showing the parts of an electrical conduction means used in a miniature light bulb string according to the invention.
Figure 2:
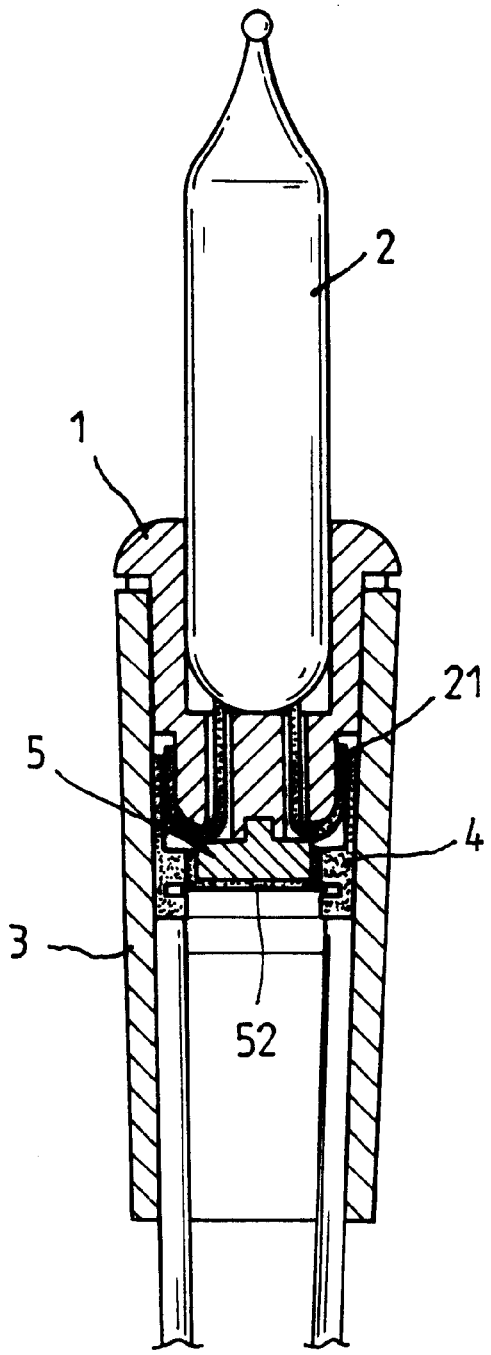
FIG. 2 is a cross sectional view illustrating a light bulb holder using the electrical conduction means according to the invention.

As shown in FIGS. 1 and 2, the invention comprises a connection sleeve (1) with a miniature light bulb (2) seated on the top thereof and a slot (11) formed on the bottom face thereof. Two conductive leads (21) of the light bulb (2) pass through the connecting sleeve (1) and then are bent toward two sides respectively. A coupling block (5) has a protrusion (51) disposed on the top face and is covered on the bottom by a U-shaped conductor plate (52). The coupling block (5) is integrated with the connection sleeve (1) by the insertion of the protrusion (51) into the slot (11). Provided in the holder shell (3) is two conductive terminals (4), oppositely disposed and each affixed by an electrical conductor wire (41).

In assembly, the connection sleeve (1) is inserted into the interior of the holder shell (3) and two conductive leads (21) are held in contact with terminals (4) while the U-shaped conductor plate (52) presses against the lower end of the terminals (4). Thus an electrical connection is built between the conductor plate (52) and the terminals (4). Such an arrangement can maintain electrical current in a light bulb string when one of the miniature light bulbs (2) of the string fails. Users can detect broken light bulbs with ease and replace it. The present invention indeed eliminates annoyance existing in a prior art structure.

From the above description, evidently the invention can achieve the objects set forth at the beginning of the text. Also it has a compact structure and provides convenience in assemblage as well as a positive conductive performance that has never been found in a prior art light bulb string having series connection circuits. Compared to a prior art ones the invention is a technical advance in industry.

Figure 3:
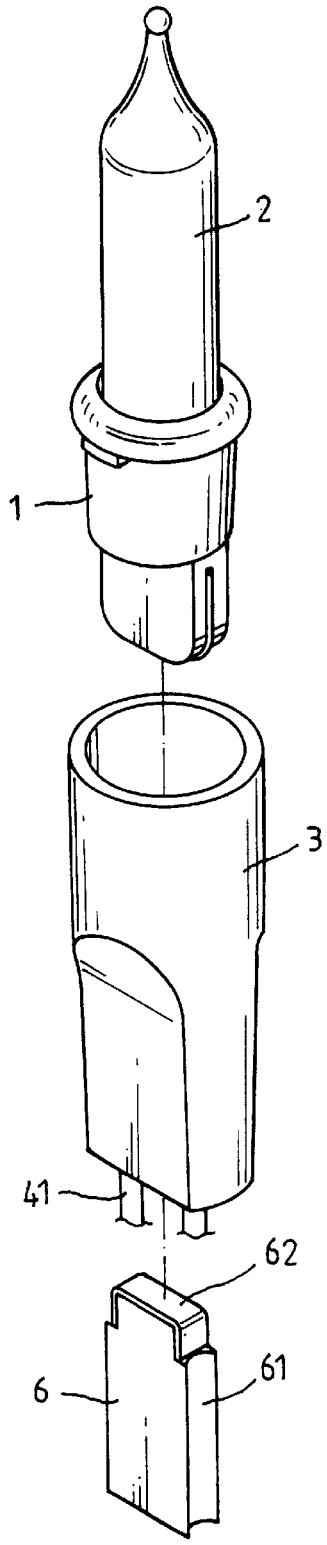
FIG. 3 is an exploded view depicting a variant application according to the invention.
Figure 4:
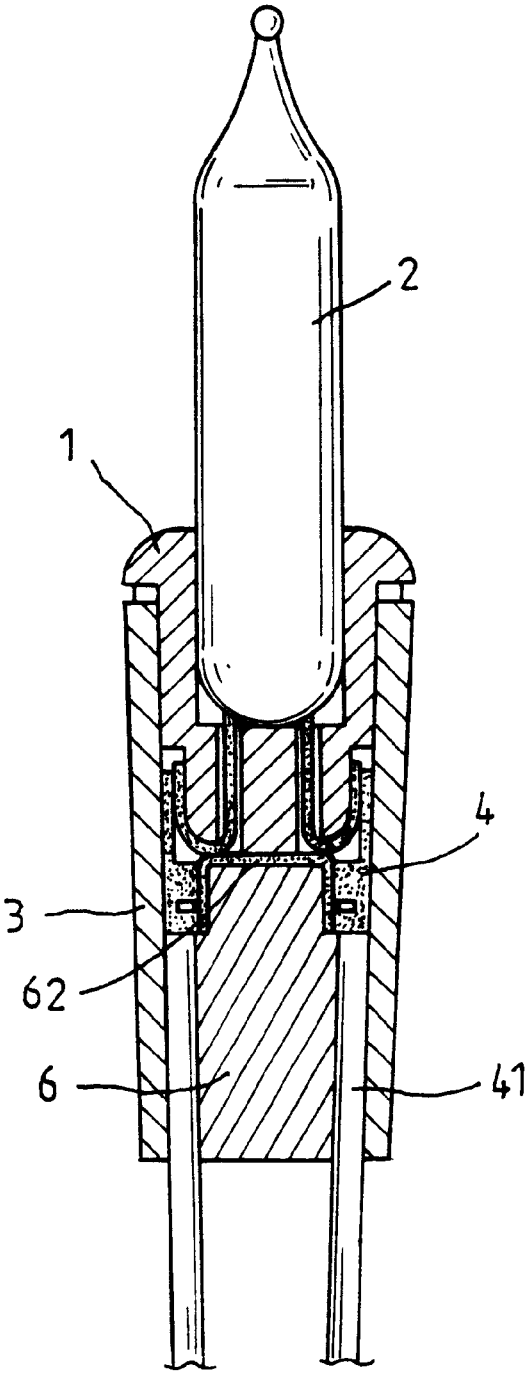
FIG. 4 is a cross sectional view showing the light bulb holder of figure 3.

A variant application according to the invention is shown in FIGS. 3 and 4. The variant is a waterproof light bulb string that has also a parallel connection circuit and consists of a connection sleeve (1), a miniature light bulb (2) and a holder shell (3). The embodiment is featured by a plug (6) that is provided with a round groove (61) on two opposite sides and a U-shaped conductor plate (62) on the top. When the plug is placed into the lower portion of a holder shell (3), the opposed conductive terminals (4) on the inner side wall of the shell (3) abut against the U-shaped conductor plate (62) to form an electrical connection. Meanwhile, the round grooves (61) press against electrical wire (41) to achieve a waterproof effect. Such design is also advantageous in manufacturing and assembling due to the simplicity of construction. Besides, it provides a waterproof feature that can not be acquired by a prior art structure. This is another technical advance.

In summary, the present invention uses a U-shaped conductor plate to build electrical connection between two opposite conductive terminals and to cooperate with a plug or block to form an easy-to-assemble light bulb holder structure. It acquires excellent convenience and practical benefit in field. Evidently it has the essence of a patent.

What is claimed is:

1. An electrical connection means used in a decorative miniature light bulb string comprising a connection sleeve with a miniature light bulb seated in a top end thereof and a slot formed in a bottom end of tie connection sleeve, a coupling block having a protrusion formed on an upper end and covered on a lower end with a U-shaped conductor plate and integrated with a light bulb holder shell by the engagement or the slot with the protrusion, and two conductive terminals oppositely disposed in the holder.

2. An electrical connection means used in a decorative miniature light bulb string comprising a connection sleeve, a miniature light bulb, a holder shell and a sealing plug provided in two sides thereof with round grooves and covered on a top end with a U-shaped conductor plate; said plug being inserted into the holder shell and said U-shaped conductor plate thereby being brought into contact with respective conductive terminals disposed in the side grooves while said grooves respectively press against electrical wire to achieve a waterproof effect, said U-shaped conductor plate providing a current path in parallel with said miniature light bulb.

* * * * *